US011291242B2

(12) United States Patent
Yanchev et al.

(10) Patent No.: US 11,291,242 B2
(45) Date of Patent: Apr. 5, 2022

(54) APPARATUS AND METHOD FOR FORMING A SMOKE FILTER

(71) Applicant: Aiger Group AG, Zug (CH)

(72) Inventors: Dimitar Yanchev, Plovdiv (BG); Kaloyan Yanchev, Plovdiv (BG); Ivan Ikov, Plovdiv (BG)

(73) Assignee: AIGER GROUP AG, Zug (CH)

( * ) Notice: Subject to any disclaimer, the term of this patent is extended or adjusted under 35 U.S.C. 154(b) by 337 days.

(21) Appl. No.: 16/553,529

(22) Filed: Aug. 28, 2019

(65) Prior Publication Data

US 2021/0059296 A1 Mar. 4, 2021

(51) Int. Cl.

| | |
|---|---|
| ***A24D 3/02*** | (2006.01) |
| ***A24D 3/10*** | (2006.01) |
| ***A24D 3/06*** | (2006.01) |

(52) U.S. Cl.

CPC ..... *A24D 3/0229* (2013.01); *A24D 3/063* (2013.01); *A24D 3/10* (2013.01)

(58) Field of Classification Search

None

See application file for complete search history.

(56) References Cited

U.S. PATENT DOCUMENTS

| | | | | |
|---|---|---|---|---|
| 3,648,711 A | | 3/1972 | Berger | |
| 3,811,451 A | | 5/1974 | Berger | |
| 3,847,064 A | * | 11/1974 | Berger | A24D 3/0225 493/44 |
| 3,994,306 A | | 11/1976 | Berger | |
| 1,022,221 A | | 5/1977 | Berger | |
| 1,022,722 A | | 5/1977 | Berger | |
| 4,024,012 A | | 5/1977 | Sigmon | |

(Continued)

FOREIGN PATENT DOCUMENTS

| | | |
|---|---|---|
| BE | 773622 A | 1/1972 |
| CN | 201398452 Y | 2/2010 |

(Continued)

OTHER PUBLICATIONS

Extended European Search Report dated Jun. 4, 2020, including the European Search Report and the European Search Opinion, in connection with corresponding EP Application No. 19202148.3 (9 pp.).

(Continued)

*Primary Examiner* — Dennis R Cordray

(74) *Attorney, Agent, or Firm* — Maier & Maier, PLLC

(57) ABSTRACT

A system, apparatus and method for forming a smoke filter including a forming nozzle through which a fibrous bundle material passes. The forming nozzle includes a converging passage, at least one first internal cavity in fluid connection with a first working fluid source, and a plurality of first holes fluidly connecting the at least one first internal cavity with a working surface of the forming nozzle. The plurality of first holes are further positioned and directed such that in passing through the plurality of first holes, the first working fluid conveys the fibrous bundle material through the forming nozzle in a transport direction. A guide pin is disposed along a central axis of the converging passage, the guide pin including an elongated body which tapers in the transport direction. A bobbin disposed downstream of the forming nozzle.

16 Claims, 7 Drawing Sheets

(56) References Cited

U.S. PATENT DOCUMENTS

| | | | | |
|---|---|---|---|---|
| 4,026,306 | A | 5/1977 | Berger | |
| 4,075,936 | A | 2/1978 | Berger | |
| 4,291,711 | A | 9/1981 | Berger | |
| 4,357,950 | A | 11/1982 | Berger | |
| 4,637,409 | A | 1/1987 | Berger | |
| 6,814,786 | B1 | 11/2004 | Zhuang et al. | |
| 8,627,825 | B2 | 1/2014 | Nelson et al. | |
| 9,149,072 | B2 | 10/2015 | Conner et al. | |
| 9,220,297 | B2 | 12/2015 | Sebastian et al. | |
| 10,645,969 | B2 * | 5/2020 | Caprini | A24D 3/0229 |
| 2007/0074733 | A1 | 4/2007 | Rasouli et al. | |
| 2007/0117700 | A1 | 5/2007 | Kushihashi et al. | |
| 2007/0204869 | A1 | 9/2007 | Sampson et al. | |
| 2013/0231232 | A1 * | 9/2013 | Giannini | A24D 3/0229 493/44 |
| 2019/0110516 | A1 | 4/2019 | Zhang et al. | |

FOREIGN PATENT DOCUMENTS

| | | | |
|---|---|---|---|
| CN | 104770874 | A | 7/2015 |
| CN | 104824841 | A | 8/2015 |
| CN | 204861142 | U | 12/2015 |
| CN | 206165800 | U | 5/2017 |
| CN | 108348000 | A | 7/2018 |
| EP | 0573279 | A1 | 12/1993 |
| EP | 1164879 | A1 | 1/2002 |
| EP | 1895863 | B1 | 12/2009 |
| EP | 2548625 | A1 | 1/2013 |
| EP | 1478248 | A1 | 3/2013 |
| EP | 2 636 321 | A1 | 9/2013 |
| EP | 2403365 | B1 | 9/2013 |
| EP | 2868215 | A2 | 5/2015 |
| EP | 1474008 | B2 | 9/2015 |
| EP | 3 379 954 | A1 | 10/2018 |
| KR | 101147679 | B1 | 5/2012 |
| WO | 03015544 | A1 | 2/2003 |
| WO | 2006117697 | A1 | 11/2006 |
| WO | 2011114440 | A1 | 9/2011 |
| WO | 2011148130 | A1 | 12/2011 |
| WO | 2013164626 | A1 | 11/2013 |

OTHER PUBLICATIONS

Chinese Office Action dated Oct. 28, 2021, in connection with corresponding Chinese Application No. 201910968922.4 (9 pp.) with English machine translation.

* cited by examiner

APPARATUS AND METHOD FOR FORMING A SMOKE FILTER

BACKGROUND

The production of smokers' goods in the tobacco industry, and in particular smoke filters, generally requires the manufacture of various rod-shaped articles. Apparatuses and methods for forming smoke filters through, for example, tow processing are known in the art but suffer from various drawbacks and inefficiencies. Thus, the disclosure described herein is for an improved apparatus, system and method for forming such smoke filters and the like

SUMMARY

In one exemplary embodiment, an apparatus which may facilitate the forming of a smoke filter, which includes a converging forming nozzle through which a fibrous bundle material is conveyed by a working fluid, a guide pin located centrally to the forming nozzle over which the filter material passes, and a bobbin through which the fibrous bundle material passes as it is infused by the same or an working fluid. The guide pin may be mechanically actuated or excited such to adjust the position or orientation of the guide pin throughout the process. The apparatus may also include additional heating or cooling sections for treatment of the fibrous bundle material that make use of the same or additional working fluids.

In another exemplary embodiment, a method by which a smoke filter may be formed, which includes passing a fibrous bundle material through a forming nozzle and over a guide pin by way of a working fluid and passing the fibrous bundle material through a bobbin such that it is infused by the same or an additional working fluid. The method may also include manipulation of the guide pin and additional heating and cooling steps which may use the same or additional working fluids.

BRIEF DESCRIPTION OF THE FIGURES

Advantages of embodiments of the present invention will be apparent from the following detailed description of the exemplary embodiments thereof, which description should be considered in conjunction with the accompanying drawings in which like numerals indicate like elements, in which.

DETAILED DESCRIPTION

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiments are not necessarily to be construed as preferred or advantageous over other embodiments. Moreover, the terms "embodiments of the invention", "embodiments" or "invention" do not require that all embodiments of the invention include the discussed feature, advantage or mode of operation.

According to an exemplary embodiment, and referring generally to the Figures, various exemplary implementations of an apparatus and method for the formation of a smoke filter may be disclosed.

Figure 1:
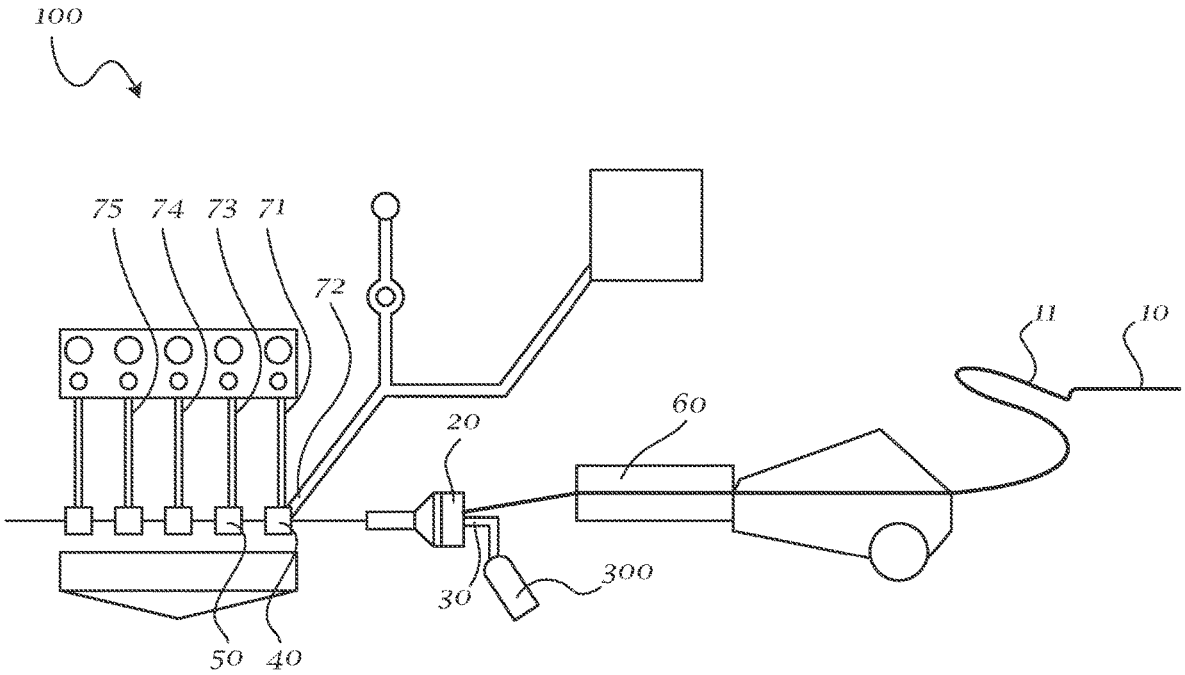
FIG. 1 is an exemplary embodiment of an apparatus configured to facilitate the formation of a smoke filter.

Turning to FIG. 1, there is provided an exemplary embodiment of an apparatus 100 configured to form a smoke filter. A filter material source 10 provides a fibrous bundle material 11 upon which the apparatus 100 acts. The fibrous bundle material 11 may consist of, for example, cellulose acetate or paper. The fibrous bundle material 11 may be supplied in various forms, passing into the apparatus 100, for example, as a sheet, a cord, or a tube. The fibrous bundle material 11 may then be conveyed through a forming nozzle 20 and over a guide pin 30.

A forming nozzle 20 and guide pin 30 serve to convert the shape of the fibrous bundle material 11 into a desired shape or a desired intermediate shape prior to further processing. The converging passage 22 of the forming nozzle 20 is preferably shaped as a converging prism. The cross section of the converging passage 22 of the forming nozzle 20 may be, in on exemplary embodiment, cylindrical, however any suitable cross section may be used. The cross section of the converging passage 22 need not be symmetrical about any axis, and irregular or oblong shapes may be used to accommodate various formats of the fibrous bundle material or to accommodate the needs of any supporting elements of the guide pin. The rate of convergence of the converging passage 22 also need not be constant.

The forming nozzle 20 may be further provided with at least one internal cavity 28 and a working surface 24. The working surface 24 of the forming nozzle 20 may be defined as the surface by which the fibrous bundle material 11 proximately passes. While the working surface 24 may be coincident with an interior surface of the forming nozzle 20 or the surface of the converging passage 22, the working surface 24 is not limited by these features. The working surface 24 may also be provided with a plurality of holes 26 or perforations which create a fluid connection between the working surface 24 and the internal cavity 28 of the forming nozzle 20. The internal cavity 28 of the forming nozzle 20 may also be in fluid connection with a working fluid source 71. Thus, a fluid circuit may be created which extends from the working fluid source 71 to the working surface 24. A working fluid provided by the working fluid source may thus exit this fluid circuit at the plurality of holes 26.

The plurality of holes 26 of the working surface 24 of the forming nozzle 20 may thus be positioned and directed such to create a propulsive force which conveys the fibrous bundle material 11 through the forming nozzle 20. Thus, the direction in which the fibrous bundle material 11 is conveyed establishes a transport direction, which in another exemplary embodiment may also be described as a vector defined by the axis about which the converging passage 22 converges and the direction of convergence.

The working fluid provided by the working fluid source 71 may also, in coming into contact with the fibrous bundle material 11, conduct a process upon the fibrous bundle material 11 such as heating, cooling, chemical reaction, or any combination thereof.

The guide pin 30 is an elongated body of variable cross section with a tapered tip 32. The guide pin may be disposed centrally with respect to the converging passage 22 and may be aligned with the transport direction of the fibrous bundle material 11 such that the tapered tip 32 points approximately in the transport direction. The disposition of the guide pin 30 with respect to the converging passage 22 need not be the geometric center of the converging passage, and, while preferable in some exemplary embodiments, may be specifically avoided in other exemplary embodiments. Precise alignment of the guide pin 30 and tapered tip 32 with the transport direction is also unnecessary and, while preferable in some exemplary embodiments, may be specifically avoided in other exemplary embodiments.

The tapered tip 32 of the guide pin 30 may be of arbitrary cross section and is not limited to a circular cross section. In some exemplary embodiments, a cross section in the shape of an X, a triangle, a star, a square, a toothed gear, a crescent, or any other number of arbitrary shapes may be preferable. The cross section may be a convex shape and does not need to be symmetrical across any plane. The cross section may also resolve into multiple, separate shapes as the tip tapers.

The guide pin 30 may be secured by either a static or a dynamic support 34. In some preferred embodiments, this support may be also secured to the forming nozzle 20. In other preferred embodiments, this support may be attached to a separate support structure. In instances where the guide pin 30 is secured to a dynamic support, the guide pin 30 may thus be manipulated during operation to alter its positioning relative to the forming nozzle 20. By manipulating the guide pin 30 during operation of the apparatus 100, a variety of internal shapes or structures may be created within the smoke filter product. In one exemplary embodiment, shifting the guide pin 30 axially with respect to the forming nozzle 20 may thus create voids and closures within the smoke filter product. In another exemplary embodiment, rotating the guide pin 30 about its central axis may create more intricate voids within the smoke filter product. Rotating the guide pin 30 about its central axis may also be used to reduce friction between the guide pin 30 and the fibrous bundle material 11. In yet another exemplary embodiment, adjusting the alignment of the guide pin 30 relative to the transport direction may also allow finer control of the shaping of voids within the smoke filter product.

In one preferable embodiment, the guide pin 30 and/or the tapered tip 32 of the guide pin may be constructed from a firmly rigid material. In another preferable embodiment, the guide pin 30 and/or the tapered tip 32 of the guide pin may be constructed of a non-rigid material. When constructed of a non-rigid material, the guide pin 30 and/or tapered tip 32 may thus perform a self-centering function whereby the friction forces between the fibrous bundle material 11 and the guide pin 30 and/or tapered tip 32 cause the latter to deform such to more precisely align with the center of the fibrous bundle material 11 stream. As such, the non-rigid material is one preferably strong enough to maintain the desired cross-sectional shape but flexible enough to elastically deform with respect to these demands. While it may be preferable in one embodiment to restrict all deformations to the elastic regime of the material, in other embodiments it may be suitable or even preferable if the deformations occur in the plastic regime of the material.

A bobbin 40 is provided, which includes a passage 42 through which the fibrous bundle material 11 may be conveyed. The bobbin 40 further may include at least one internal cavity 44 that is in fluid connection with a working fluid source 72. The passage 42 of the bobbin 40 may also be provided with a plurality of holes 46 which create a fluid connection with at least one internal cavity 44. Thus, a fluid circuit is created which connects the working fluid source 72 with the passage 42 of the bobbin 40. In this manner, a working fluid provided by the working fluid source 72 may be brought into contact with the fibrous bundle material 11 in the passage 42 of the bobbin 40.

The position and orientation of the plurality of holes 46 in the passage 42 of the bobbin 40 may, in one exemplary embodiment, be such that a propulsive force is applied to the fibrous bundle material 11 which serves to convey the fibrous bundle material 11 through the bobbin 40. In another exemplary embodiment, the position and orientation of the plurality of holes 46 may also be such to further facilitate or enable a process conducted by a working fluid provided by working fluid source 72 upon the fibrous bundle material 11, for example, heating, cooling, chemical reaction, or any combination thereof. In one advantageous embodiment, the working fluid provided by working fluid source 72 is steam, which may serve to cook the fibrous bundle material 11 as it passes through the passage 42.

In another exemplary embodiment, at least one cooling station 50 may be provided downstream of the bobbin. Each cooling station is provided with a passage 52 through which the fibrous bundle material 11 may be conveyed and at least one internal cavity 54 in at least one fluid connection with a working fluid source 73-75. In this manner, a working fluid provided by a working fluid source 73-75 may enter into the internal cavity 54. In a preferred embodiment, the working fluid is provided to the internal cavity 52 of a cooling station 50 in order to provide convective cooling of the fibrous bundle material 11 as it passes through the passage 52 of the cooling station 50. In such an embodiment, the internal cavity 54 may include at least a second fluid connection with the respective working fluid source 73-75 such that the working fluid provided by the working fluid source 73-75 may be recirculated through the cooling station.

In another exemplary embodiment, each cooling station may also operatively be provided with a plurality of holes 56 which create a fluid connection between the passage 52 and internal cavity 54 of the cooling station 50. In this manner, a working fluid provided by the working fluid source 73-75 may be brought into contact with the fibrous bundle material 11. The plurality of holes 56 may be positioned and oriented such that the working fluid thus provided creates a propulsive force to convey the fibrous bundle material 11 through the cooling station 50. The plurality of holes 56 may also be positioned and oriented such that the working fluid thus provided may conduct a process upon the fibrous bundle material, for example, cooling, chemical reaction, or any combination thereof.

In another exemplary embodiment, at least one heating element 60 may be provided in proximity to the fibrous bundle material 11 stream. The heating element 60 may constitute an infrared heating device, a heating coil, or other similar device meant to heat the fibrous bundle material 11 as it passes in proximity to the heating element 60. A heating element 60 may, in one exemplary embodiment, be advantageously disposed upstream of the forming nozzle 20. A heating element 60 may, in another exemplary embodiment may be placed downstream of the forming nozzle 20 or bobbin 40. In yet another exemplary embodiment, a heating element 60 may be placed upstream, downstream, or in between any number of cooling stations 50.

A number of working fluid sources 71-75 are provided for the operation of the various components of the apparatus 100. Additional working fluid sources may also be provided depending on the needs and number of their corresponding components. The working fluids provided by the working fluid sources 71-75 may range from ambient air, compressed air, water, and steam. The working fluids provided by the working fluid sources 71-75 may also be at a variety of temperatures as needed by the corresponding components. The working fluid sources 71-75 may thus, in one exemplary embodiment, be configured to provide individualized working fluids to each component of the apparatus 100. In another exemplary embodiment, one or more working fluid source 71-75 may provide the same working fluid another working fluid source 71-75. Additionally, one or more working fluid source 71-75 may be the same working fluid source, such as, in one exemplary embodiment, the same compressed air tank. For example, in one advantageous embodiment, working fluid source 71 may provide pressurized ambient air which may or may not be pre-heated, working fluid source 72 may provide steam, and working fluid sources 73-75 may provide pressurized ambient air from the same source which may or may not have been pre-cooled. In another advantageous embodiment, working fluid sources 71 and 72 may both provide steam. In another advantageous embodiment, working fluid sources 73-75 may provide pressurized air at different temperatures.

Figure 2A:
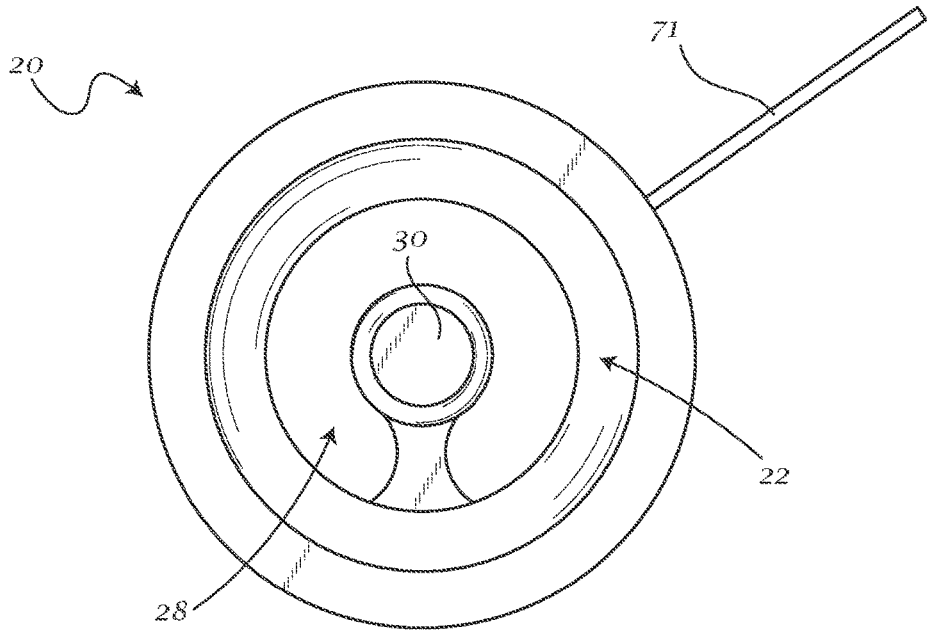
FIG. 2A is an exemplary embodiment of a forming nozzle of an apparatus configured to facilitate the formation of a smoke filter.
Figure 2B:
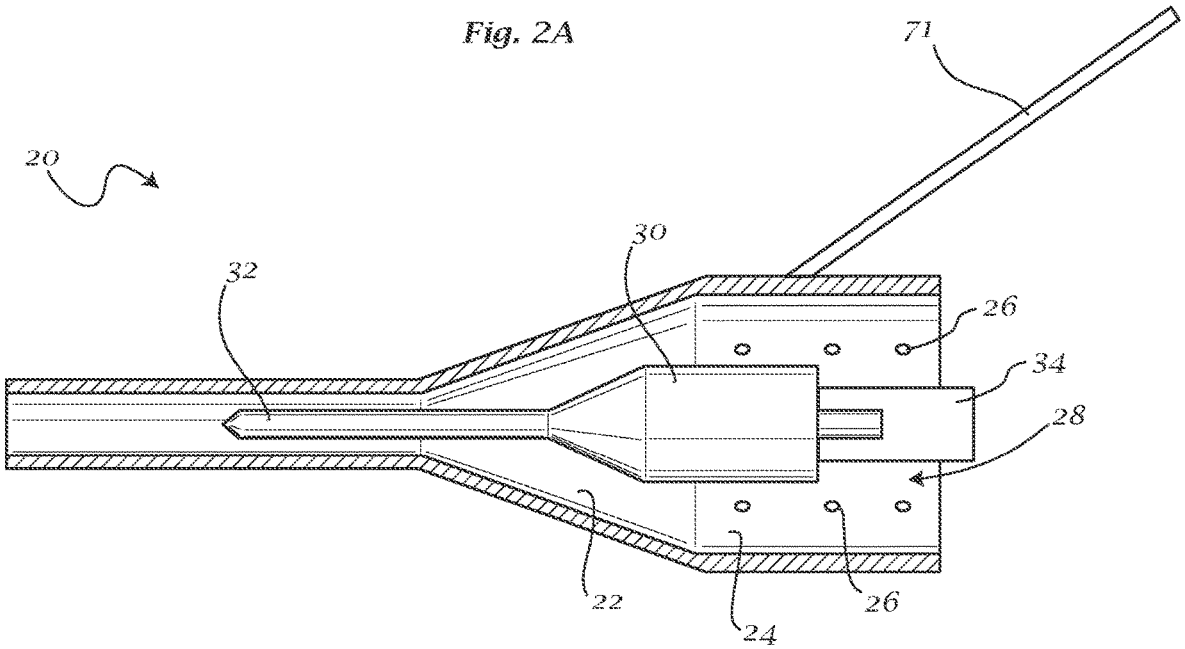
FIG. 2B is an exemplary embodiment of a forming nozzle and guide pin of an apparatus configured to facilitate the formation of a smoke filter.

Turning to FIG. 2A and FIG. 2B, there is provided an exemplary embodiment of a forming nozzle 20, the converging passage 22, the working surface 24, the plurality of holes 26, and the internal cavity 28. The end of the guide pin 30 opposite that of the tapered tip may also be seen as an exemplary embodiment of how the guide pin 30 may interface with the forming nozzle 20.

Figure 2C:
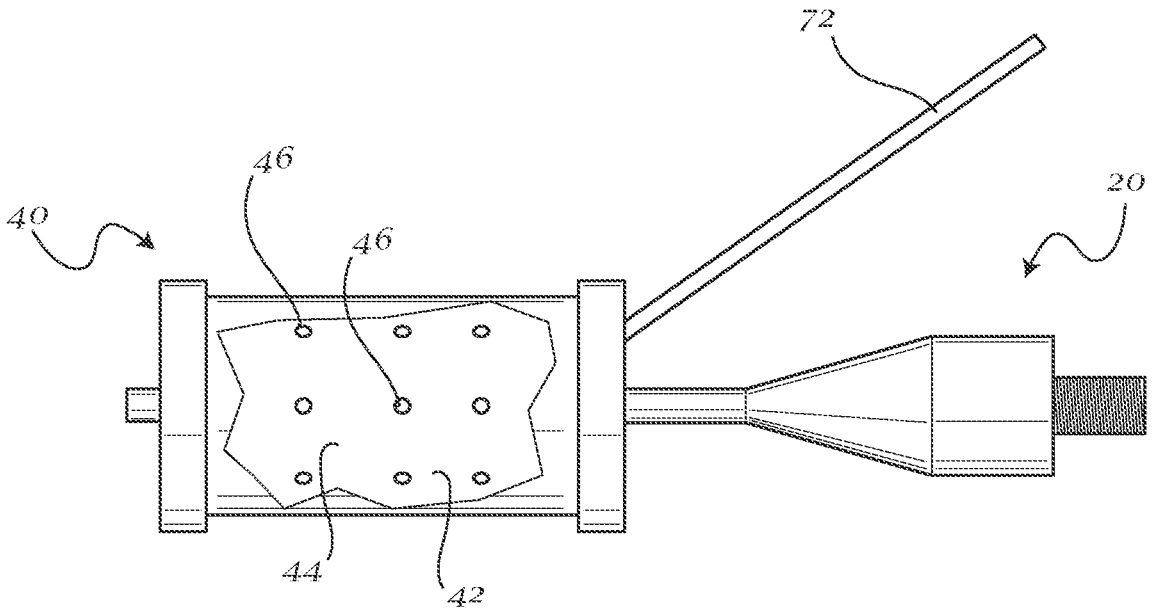
FIG. 2C is an exemplary embodiment of a bobbin of an apparatus configured to facilitate the formation of a smoke filter.

Turning to FIG. 2C, there is provided an exemplary embodiment of a bobbin 40, as well as one configuration in which the guide pin 30 interfaces with the bobbin 40. Also shown are a passage 42, internal cavity 44, plurality of holes 46, and a working fluid source 72.

Figure 2D:
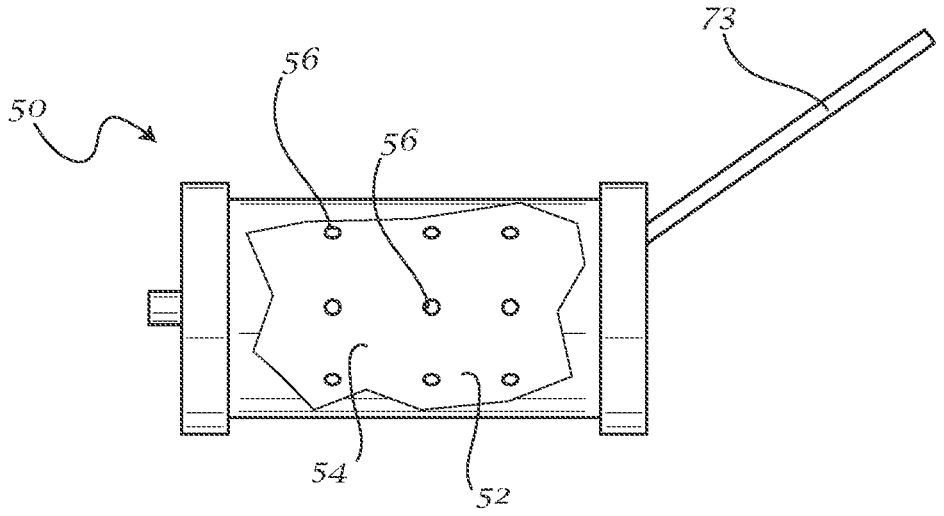
FIG. 2D is an exemplary embodiment of a cooling station of an apparatus configured to facilitate the formation of a smoke filter.

Turning to FIG. 2D, there is provided an exemplary embodiment of a cooling station 50, a passage 52, an internal cavity 54, a plurality of holes 56, and a working fluid source 73.

Figure 3A:
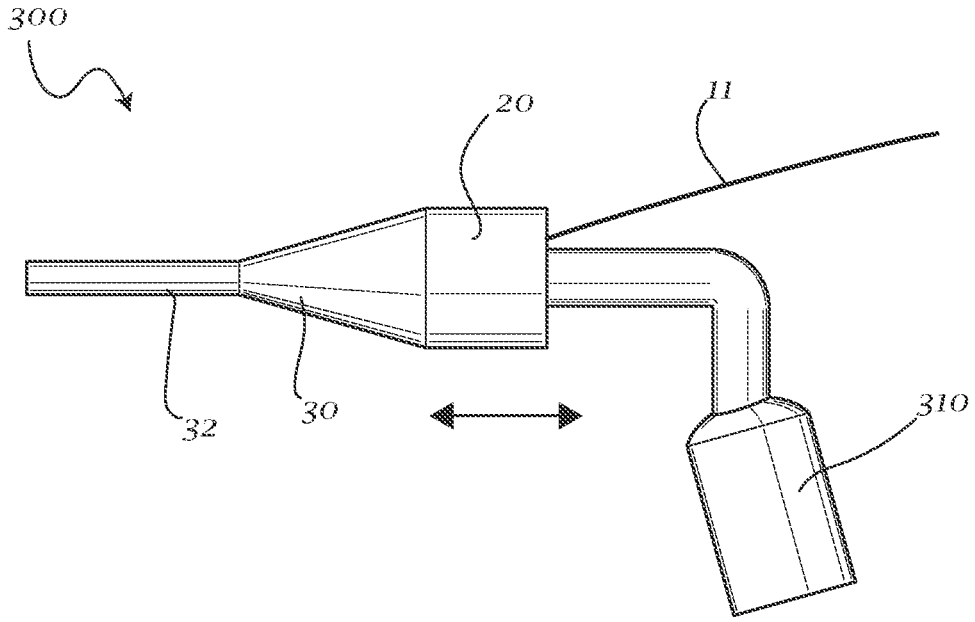
FIG. 3A is an exemplary embodiment of one possible configuration of the guide pin of an apparatus configured to facilitate the formation of a smoke filter.

Turning to FIG. 3A, there is provided an exemplary embodiment of a dynamic support 300 for a guide pin 30. In one advantageous embodiment, the dynamic support 300 consists of an armature 310 configured to translate the guide pin 30 axially with reference to the forming nozzle 20. By extending the guide pin 30 axially downstream, the fibrous bundle material 11 may thus flow past and over the tapered tip 32 of the guide pin such that the fibrous bundle material does not close into a solid shape as it flows through the forming nozzle 20, creating a void in the middle of the finalized smoke filter product. By retracting the guide pin 30 axially upstream, the fibrous bundle material 11 may thus flow through the forming nozzle without coming into contact with the guide pin 30 such that the fibrous bundle material 11 closes as it passes through the forming nozzle 20, creating a solid prism material in the finalized smoke filter product. In this manner, a periodic, axial oscillation or reciprocation of the guide pin 30 may serve to create repeated patterns of voids and solid sections in the finalized smoke filter product.

Figure 3B:
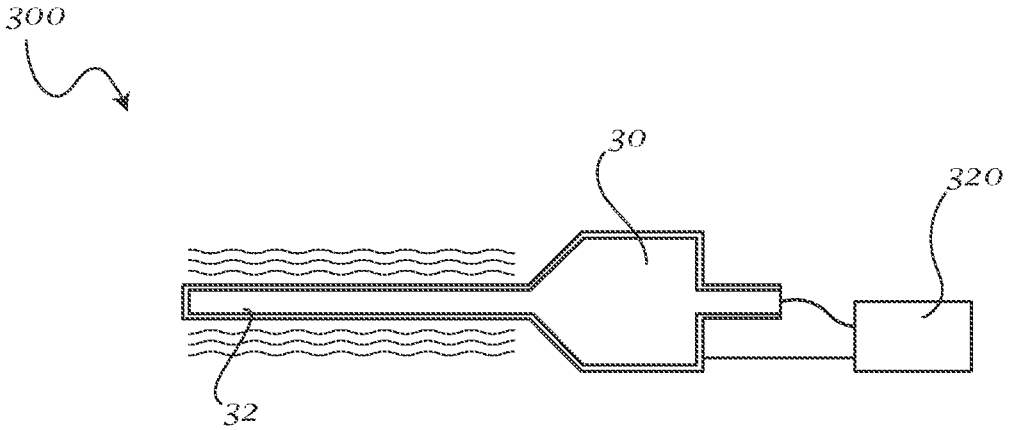
FIG. 3B is another exemplary embodiment of one possible configuration of the guide pin of an apparatus configured to facilitate the formation of a smoke filter.

Turning to FIG. 3B, there is provided another exemplary embodiment of a dynamic support 300 for a guide pin 30. In another advantageous embodiment, the dynamic support 300 consists of a vibration generator 320 which is linked to the guide pin 30 such that vibrations generated by the vibration generator 320 are transferred mechanically to the tapered tip 32. Such vibrations may be configured to assist in the reduction of friction between the guide pin 30 and the fibrous bundle material 11 as the two come into contact. This reduction of friction may reduce wear on the guide pin 30, as well as may serve to reduce the introduction of imperfections to the resulting smoke filter product. In one advantageous embodiment, the vibration generator is configured to provide vibrations at ultrasonic frequencies or frequencies higher than 10 kilohertz. In another exemplary embodiment, vibrations at frequencies of 10 kilohertz or lower may also be used to the same effect.

Figure 3C:
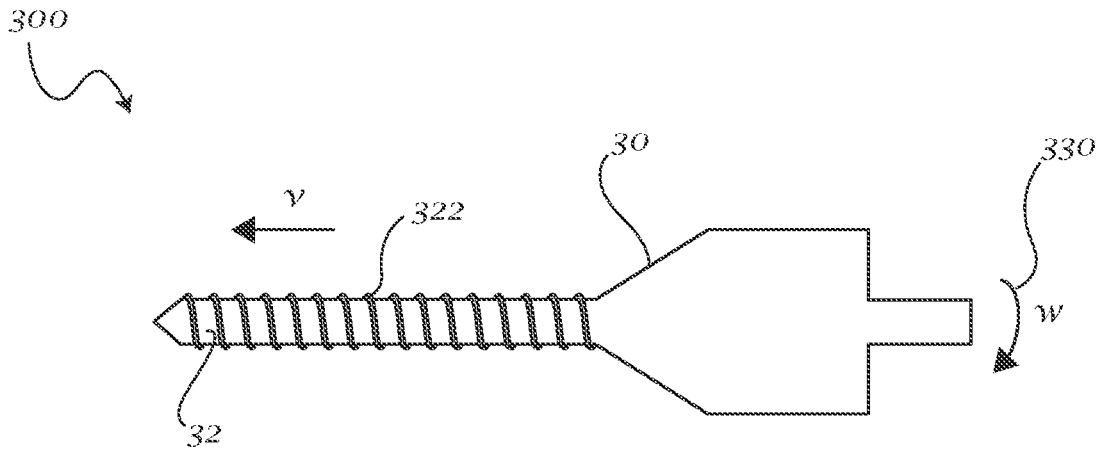
FIG. 3C is another exemplary embodiment of one possible configuration of the guide pin of an apparatus configured to facilitate the formation of a smoke filter.

Turning to FIG. 3C, there is provided an exemplary embodiment of a dynamic support 300 for a guide pin 30. In another advantageous embodiment, the dynamic support 300 consists of a motor 330 used to rotate the guide pin 30 about its long axis. This rotation, when coupled with certain cross-sectional shapes of the tapered tip 32, may be used to introduce more intricately shaped voids within the finalized smoke filter product. The motor 330 thus provided may be a servomotor, a stepper motor, a brushless motor, a brushed motor, or similar electric motor as best suits the desired shapes. The rotation of the guide pin 30 may also serve to reduce friction between the guide pin 30 and fibrous bundle material 11. This reduction in friction, as stated before, may serve to reduce wear on the guide pin 30 and reduce imperfections in the final product.

In another exemplary embodiment, the tapered tip 32 may also be further provided with a screw thread 322. Such a screw thread 322 may be coarse, fine, or some measure in between. For some cross sections, the screw thread 322 may be provided solely to reduce friction between the tapered tip 32 and the fibrous bundle material 11. For other cross sections, the screw thread 322 may be configured such that when considering the forward velocity of the fibrous bundle material 11 and any potential twist or rotation imposed on the same, a relative rotational velocity of zero may be maintained between the desired cross sectional void shape of the fibrous bundle material 11 and the cross sectional shape of the guide pin 30 and tapered tip 32. In light of this, the screw thread 322 may also not be restricted to the conventional screw shape, but merely reflect a rotated cross section that, as a result, would appear screw-like.

Figure 3D:
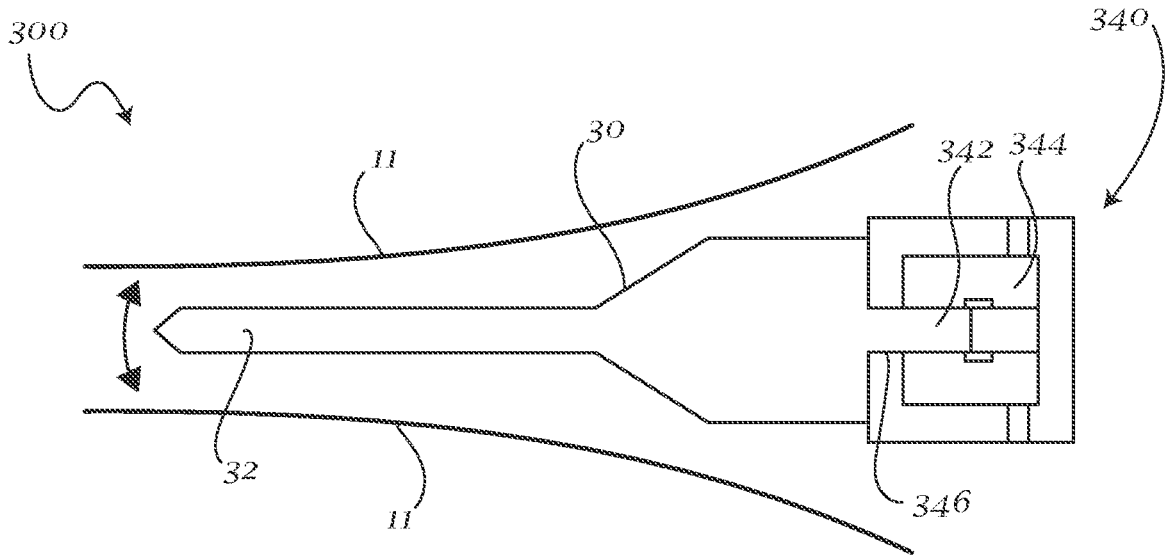
FIG. 3D is another exemplary embodiment of one possible configuration of the guide pin of an apparatus configured to facilitate the formation of a smoke filter.

Turning to FIG. 3D, there is provided another exemplary embodiment of a dynamic support 300 for a guide pin 30. In another advantageous embodiment, the dynamic support 300 consists of a pneumatic alignment system 340. In those instances where the guide pin 30 and/or tapered tip 32 are constructed of a rigid material, it may be preferable to allow some manner to keep the tip 32 more precisely centered with the stream of fibrous bundle material 11 as that target fluctuates. To achieve this alignment, the upstream end of the guide pin 30 may further comprise a levered end 342 which protrudes into a pressure chamber 344. The pressure chamber 344 is configured such that as the levered end 342 deflects with response to motion of the tapered tip 32, the pressure chamber 344 may exert a force countering this deflection.

The pressure chamber 344 may be configured such that deflection of the levered end 342 causes a reduction of volume, and thus an increase in pressure and counter-acting force, of any number of individual, pressurized cells of the pressure chamber 344. The pressure chamber 344 may also be configured such that deflection of the levered end 342 brings the levered end 342 closer to any number of compressed-air impingement jets, leading to a higher counter-acting force. The pressure chamber 344 may also be configured such that the deflection of the levered end 342 in turn restricts any number of air channels, leading to an increase in pressure in those channels and thus an increasing, counter-acting force.

Conversely, in another preferred embodiment, the pneumatic alignment system 340 may be replaced with a spring-based system which functions in a similar manner. In place of the pressure chamber 344, the system is instead provided with a spring anchor and a number of springs attached to the levered end 342 of the guide pin 30. As such, deflection of the levered end 342 leads to an extension or contraction of any number of springs, which in turn corresponds to a force which counters the deflection.

The pneumatic alignment system 340 or its spring-based alternative may be further provided with a fulcrum 346 disposed between the pressure chamber 344 or spring anchor and the tapered tip 32.

Figure 3E:
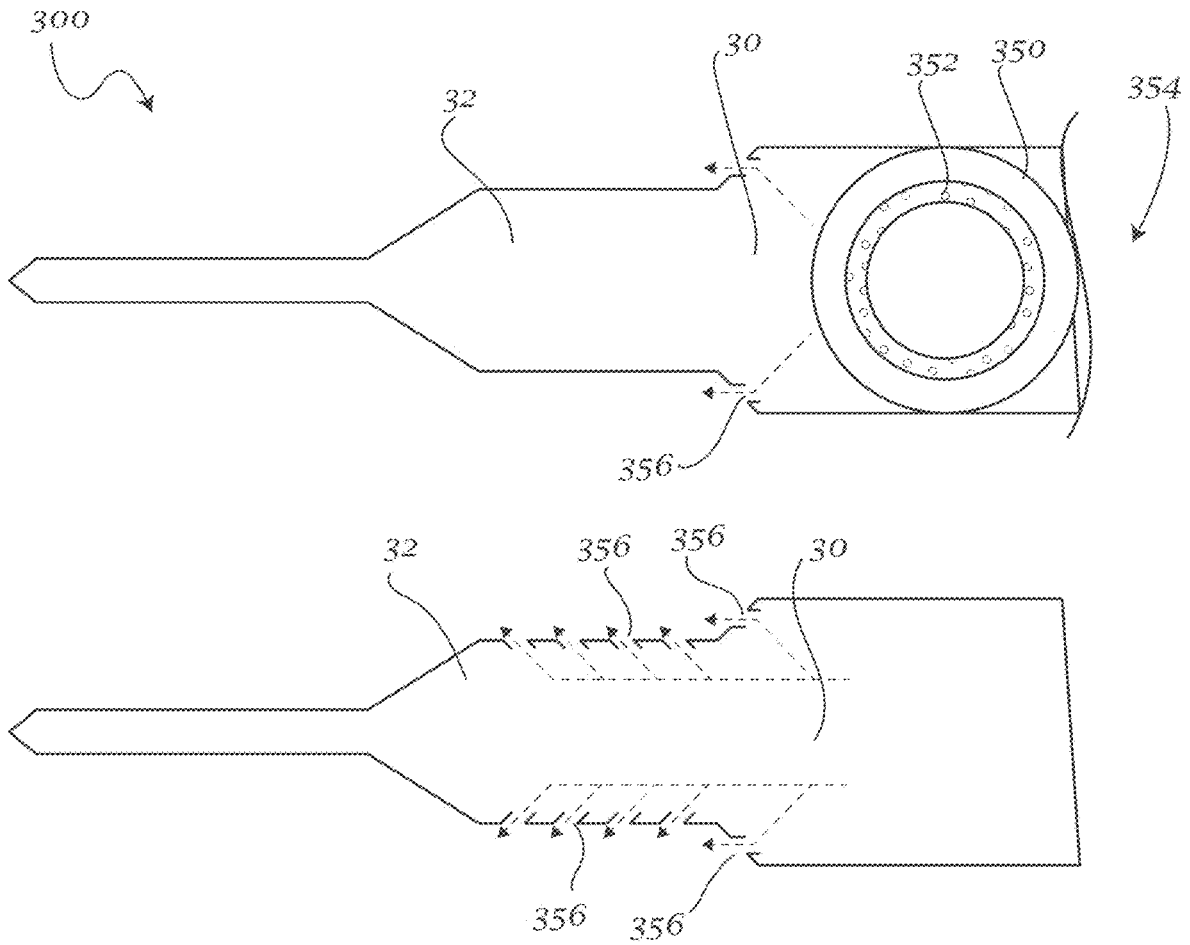
FIG. 3E is another exemplary embodiment of one possible configuration of the guide pin of an apparatus configured to facilitate the formation of a smoke filter.

Turning to FIG. 3E, there is provided another exemplary embodiment of a dynamic support 300 for a guide pin 30. In another advantageous embodiment, the dynamic support 300 consists of a fluid bearing 350. The guide pin 30 may, in one exemplary embodiment, be further provided with an internal cavity 352 connected to a working fluid source 354. The tapered tip 32 of the guide pin 30 may also be provided with a plurality of holes 356 which create a fluid connection between the internal cavity 352 and the external faces of the tapered tip 32, thus creating a fluid circuit from the working fluid source 354 to the surface of the tapered tip 32. In this manner, a working fluid may be ejected from the guide pin 30 such to impinge or infuse the fibrous bundle material 11 as it passes over the guide pin 30. In doing so, several advantages may be achieved.

By using the working fluid as a buffer between the guide pin 30 and the fibrous bundle material 11, friction between the two may be significantly reduced. This reduction of friction may thus reduce wear on the guide pin 30 as well as reduce imperfections in the final product. Additionally, the working fluid may also supplement processes worked by other stations, such as, but not limited to, the bobbin 40. In one advantageous embodiment, steam may be provided as the working fluid by the working fluid source 354 and thus serve to cook the fibrous bundle material in addition to reducing friction as the fibrous bundle material 11 passes over the guide pin 30. Other working fluids thus provided by the working fluid source 354 may include ambient air, or similar.

Figure 4:
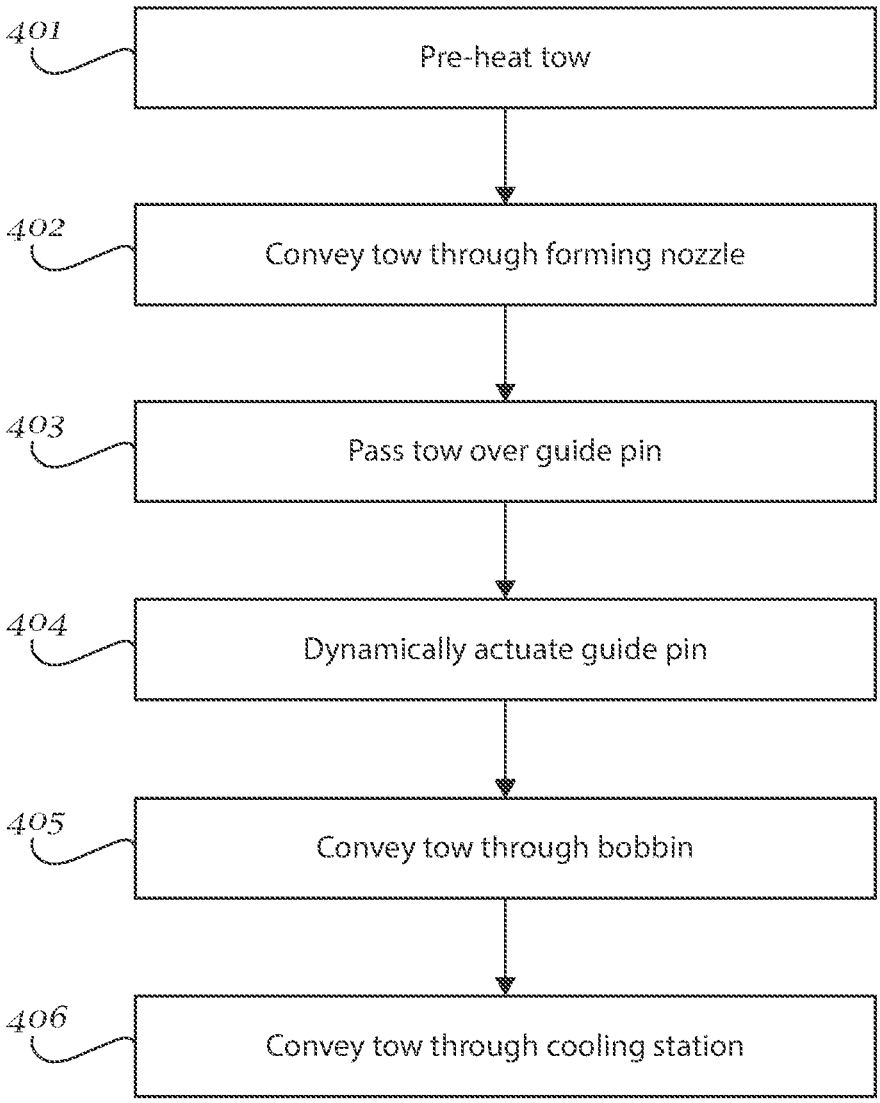
FIG. 4 is an exemplary diagram of a method by which a smoke filter may be formed.

Turning to FIG. 4, there is provided an exemplary embodiment of a method 400 for the formation of a smoke filter product. The fibrous bundle material 11, or tow, may undergo an optional pre-heating step 401 in which the fibrous bundle material 11 is brought into proximity of a heating element 60. The fibrous bundle material 11, or tow, may then be passed through a forming nozzle 20 to undergo a first forming step 402. Once formed, the fibrous bundle material 11 may then be passed over a guide pin 30 in a second forming step 403. During this second forming step 403, the guide pin may optionally be connected to a dynamic support 300 and dynamically actuated 404 to assist in the reduction of friction, to impart a desired shaping of the interior of the final smoke filter product, or both. The fibrous bundle material 11, or tow, may then be conveyed through a bobbin 40 to undergo a cooking step 405 facilitated by a working fluid source 72. Finally, the fibrous bundle material 11, or tow, may be conveyed through a cooling station 50 to undergo a cooling step 406, and this cooling step 406 may be repeated as many times as is necessary to reach a desired final temperature. Additionally, the pre-heating step 401 may occur at any point in the process prior to the cooking step 405.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art (for example, features associated with certain configurations of the invention may instead be associated with any other configurations of the invention, as desired).

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. An apparatus for forming a smoke filter comprising:

a forming nozzle through which a fibrous bundle material passes, the forming nozzle comprising a converging passage, at least one first internal cavity in fluid connection with a source of a first working fluid, and a plurality of first holes fluidly connecting the at least one first internal cavity with a working surface of the forming nozzle, the plurality of first holes further positioned and directed such that in passing through the plurality of first holes, the first working fluid conveys the fibrous bundle material through the forming nozzle in a transport direction;

a guide pin disposed along a central axis of the converging passage, the guide pin comprising an elongated body which tapers in the transport direction and an excitation device, wherein the excitation device is a vibration generator linked vibrationally to the guide pin; and a bobbin disposed downstream of the forming nozzle, the bobbin comprising a first passage through which the fibrous bundle material is conveyed, at least one second internal cavity in fluid connection with a source of a second working fluid, and a plurality of second holes fluidly connecting the at least one second internal cavity with the first passage, the plurality of second holes positioned such that in passing through the plurality of second holes, the second working fluid infuses the fibrous bundle material.

2. The apparatus according to claim 1, in which the guide pin is mounted to a translational device which displaces the guide pin axially with respect to the forming nozzle.

3. An apparatus for forming a smoke filter comprising:

a forming nozzle through which a fibrous bundle material passes, the forming nozzle comprising a converging passage, at least one first internal cavity in fluid connection with a source of a first working fluid, and a plurality of first holes fluidly connecting the at least one first internal cavity with a working surface of the forming nozzle, the plurality of first holes further positioned and directed such that in passing through the plurality of first holes, the first working fluid conveys the fibrous bundle material through the forming nozzle in a transport direction;

a guide pin disposed along a central axis of the converging passage, the guide pin comprising an elongated body which tapers in the transport direction and an excitation device, wherein the excitation device is a motor non-rotationally connected to the guide pin; and a bobbin disposed downstream of the forming nozzle, the bobbin comprising a first passage through which the fibrous bundle material is conveyed, at least one second internal cavity in fluid connection with a source of a second working fluid, and a plurality of second holes fluidly connecting the at least one second internal cavity with the first passage, the plurality of second holes positioned such that in passing through the plurality of second holes, the second working fluid infuses the fibrous bundle material.

4. The apparatus according to claim 1, in which the guide pin further comprises a screw thread.

5. The apparatus according to claim 1, in which the guide pin further comprises:

at least one third internal cavity in fluid connection with a source of a third working fluid; and a plurality of third holes fluidly connecting the at least one third internal cavity and an exterior of the guide pin.

6. The apparatus according to claim 5, wherein the first working fluid and the third working fluid are the same.

7. The apparatus according to claim 1, further comprising:

at least one heating element disposed adjacent to a stream of the fibrous bundle material.

8. The apparatus according to claim 1, further comprising:

at least one cooling station disposed downstream of the bobbin, comprising a second passage through which the fibrous bundle material is conveyed and at least one fourth internal passage in at least one fluid connection with a source of a fourth working fluid, through which the fourth working fluid is passed such to cool the fibrous bundle material.

9. The apparatus according to claim 8, wherein the at least one cooling station further comprises:

a plurality of fourth holes fluidly connecting the at least one fourth internal passage and the second passage such that the fourth working fluid impinges upon the fibrous bundle material.

10. The apparatus according to claim 9, wherein the first working fluid and the fourth working fluid are the same.

11. The apparatus according to claim 1, in which the first working fluid and the second working fluid are the same.

12. A method for forming a smoke filter comprising:

flowing a first working fluid through an aspirated forming nozzle such to convey a fiber bundle material through the forming nozzle and over a guide pin located centrally with respect to the forming nozzle, wherein the guide pin comprises an excitation device that is a vibration generator linked vibrationally to the guide pin; and flowing a second working fluid through an aspirated bobbin such to infuse the fiber bundle material with the second working fluid as the fiber bundle material is conveyed through the bobbin.

13. The method according to claim 12, wherein the guide pin is mechanically actuated such that the guide pin is subject to at least one of:

a translational reciprocation along a first central axis of the forming nozzle;

a vibration;

a rotation about a second central axis of the guide pin;

an alignment with respect to the first central axis of the forming nozzle.

14. The method according to claim 12, wherein the guide pin is aspirated such that a third working fluid is flowed through the guide pin and into a path through which the fiber bundle material passes.

15. The method according to claim 12, further comprising:

flowing a fourth working fluid through at least one cooling station such to cool the fiber bundle material as the fiber bundle material is conveyed through the cooling station.

16. The method according to claim 12, further comprising:

passing the fiber bundle material through a heating element.

* * * * *